US006039197A

United States Patent [19]

Braun

[11] Patent Number: 6,039,197

[45] Date of Patent: Mar. 21, 2000

[54] METHOD AND APPARATUS FOR SECURING THE SAME HINGED LID ASSEMBLY TO EACH OF A PLURALITY OF DIFFERENT CONTAINERS

[75] Inventor: Morris Braun, Chicago, Ill.

[73] Assignee: Kenall Manufacturing Co., Chicago, Ill.

[21] Appl. No.: 09/041,412

[22] Filed: Mar. 12, 1998

Related U.S. Application Data

[63] Continuation-in-part of application No. 08/668,864, Jun. 24, 1996, abandoned.

[51] Int. Cl.[7] ..... B65D 43/16; B65D 47/08

[52] U.S. Cl. ..... 215/228; 215/235; 220/837; 220/847; 222/556; 53/487; 53/367; 53/329

[58] Field of Search ..... 215/235, 237, 215/228; 220/212, 810, 837, 838, 847, 23.83, 23.86; 222/556; 53/487, 488, 367, 329, 331

[56] References Cited

U.S. PATENT DOCUMENTS

| | | | |
|---|---|---|---|
| 4,172,540 | 10/1979 | Erichson | 215/235 |
| 4,291,818 | 9/1981 | Nozawa et al. | 215/235 |
| 4,742,928 | 5/1988 | Braun | 215/235 |
| 4,863,048 | 9/1989 | Iizuka et al. | 215/235 |
| 5,038,957 | 8/1991 | Gross | 215/235 |
| 5,368,176 | 11/1994 | Thanisch | 215/235 |
| 5,482,172 | 1/1996 | Braddock | 215/235 |
| 5,769,253 | 7/1998 | Gross | 215/235 |

*Primary Examiner*—Nathan J. Newhouse
*Attorney, Agent, or Firm*—Michael G Berkman

[57] ABSTRACT

A closure assembly to facilitate the sealing of each of a series of necked containers, each of different body configurations and contours, with the same hinged lid. The invention thus obviates the need for relatively complex and costly molds and effects substantial savings in manufacturing costs. The first component of the closure assembly is an adapter for mounting on a given particular container. The adapter includes a skirt for sleeved securement onto the neck of the container. A plate of the adapter overlies the container neck and is formed with a through port for discharge therethrough of material stored in the container. A second component of the closure assembly consists of a lid assembly, the same lid assembly being readily attachable to each of the different adapters, and, thus, to each of the different containers. The lid assembly includes a cover overlying the plate of the cap. The cover of the lid assembly carries on the underside thereof a pintel-like plug for entry into to seal the discharge port of the adapter. The cover of the lid assembly is integrally formed with a downwardly-directed flange adapted to seat within a cooperating slot formed in the adapter. Also included, as an integrally-formed component of the lid assembly, is a "living" or "live" hinge. In the structure described, the same, single lid structure is used for each of a series of different containers.

2 Claims, 4 Drawing Sheets

METHOD AND APPARATUS FOR SECURING THE SAME HINGED LID ASSEMBLY TO EACH OF A PLURALITY OF DIFFERENT CONTAINERS

This application is a Continuation-in-Part of application Ser. No. 08/668,864 filed Jun. 24, 1996, abandoned. The instant application is a Continuation-in Part of application Ser. No. 08/668,864 filed Jun. 24, 1996.

BACKGROUND AND FIELD OF THE INVENTION

The present invention relates to an adapter and hinged lid defining a two-piece closure assembly for containers. More particularly, the invention is directed to closure assemblies in which the same hinged lid is used in each of a broad and varied collection of differently configured containers. A critical feature of the invention is that there is provided an adapter and that each adapter is configured for coupling with each specific container. The lid component is, however, the same for each container and for each closure assembly.

The entire disclosure of that application is hereby specifically incorporated herein by reference to the extent it is not inconsistent herewith.

The art is replete with containers having closures or caps of various physical configurations and designs. Closure assemblies of the type employing unitary as well as two separate components are also known. Among these prior art disclosure assemblies are structures invoking the combination of a closure cap with an auxiliary lid. In some such arrangements, a separate hinged lid carries a downwardly-projecting plug for entry into to close a dispensing orifice formed in a top neck of the container itself.

It is known to form a snap-action lid integral with a closure body and lid. Such a structure is described, for example, in Gross U.S. Pat. No. 5,123,561 issued Jun. 23, 1992. For the most part, prior art disclosures, which include hinged closure elements of the snap-action type, constitute structures in which the hinge is molded simultaneously with and is an integral part of the container cap itself. The resulting composite cap and hinged lid structure is then affixed to the container, for example, by forced snap-on attachment to the neck of the container.

The use, in conjunction with a container, of a closure of the type which includes a vented cap and an integral or unitary cooperating plug-carrying hinged cover or lid (Gross '561 patent) contributes to establishing an effective and pleasing overall package. However, the cost of molds to produce a unitary combination cap and hinged cover is inordinately and objectionally high. The problem is aggravated, and the technical challenge and expense are much increased when the diameter of the skirt of the snap-on cap is larger than the dimensions of the lid as measured from the front to the back of the hinge. Moreover, following widely adopted techniques practiced in the prior art, a physically separate, distinct and different unitary combination cap and lid mold must be made to accommodate each different container body. Again, exceedingly complex molds and associated very high costs are the result.

Exemplifying further the state of the art, Gross U.S. Pat. No. 5,038,957 issued Aug. 13. 1991 describes a specific two-piece (separate body and cap) snap-action closure as a replacement for the more common one-piece closures. Gross urges that such a substitution for the unitary body and hinged cap assembly makes it practical to use two different plastics including selectable particular plastics materials to achieve special advantages. The body component, says Gross, may be composed of a preferred, particular plastics material which is itself unsuitable for use as a living hinge. The two-component closure, Gross further urges, would permit one to use specially-selected, different combinations of materials, as well as body components and lids each differing in color.

Additionally, Gross '957 urges that use of two-piece closures would facilitate the fabrication of structures in which the lid could not be opened easily, and in which the assembly could be rendered "tamper-proof", or in which any tampering would be readily evident. It is yet another feature of the Gross two-piece closure that removal of the closure lid from the closure body would be prevented. The Gross U.S. Pat. No. 5,038,957 does not describe, teach or suggest the present invention, as disclosed and claimed.

It is, therefore, a principal aim of the present invention to circumvent and eliminate the shortcomings of prior art as well as two-piece snap-on closures of the type having hinged lids. A specific primary goal is to provide improved cap and hinged cover closure assemblies which can be reliably produced at markedly reduced cost.

SUMMARY OF THE INVENTION

The inventive concept upon which the present invention is predicated is not found in the prior art. Nor is the present invention rendered obvious by the teachings of prior art patents, considered alone or in any valid combination.

The substance of the present invention lies not in any particular inter-relationship of a container-carried body with the closure lid in a two-piece container closing assembly. Rather, the present invention is characterized in the recognition and appreciation that it is the hinged closure lid component of a two-piece closure assembly that is, by far, the most costly component to produce. That is, as compared with the lid assembly with its integrally-formed hinge, the cost of molding a container-surmounting cap or body is relatively insignificant.

An important substantive element of the present invention lies in the discovery of how to put this very significant fact to practical use and economic advantage.

It is an important feature of the present invention that the relatively inexpensive body component of the container closure assembly is used as a low-cost "adapter" or coupler. In accordance with the teachings and practice of the present invention, this adapter, interposed between the container itself and the hinged lid, may be invoked to effect very substantial savings in the fabrication of containers of the class utilizing hinged lid assemblies.

Other important and economically significant features of the "adapter" principle as taught and employed in the present invention are its simplicity, its undeniable practicality and its unqualified effectiveness.

It is a feature of the present invention that each different container is provided with its own low-cost adapter or intercoupling body component adapted to facilitate the ready attachment of the identical hinged lid assembly to each container.

A related and exceedingly important feature of the invention is that, irrespective of the container involved, a single, and the same identical hinged lid assembly is used, in each case.

It is a feature of the invention that the coupler or adapter, which is to be interposed between any specific selected container and the single, common hinged lid assembly, is characterized in that the circumambient end portion of the adapter, which abuts and engagedly locks onto a given container, is specifically and uniquely designed to accommodate the particular configuration of an upper end zone of the specific container involved.

In preferred embodiments of the invention the coupling adapter of the invention overlies and effects a fluid-impervious seal with the supporting container.

A critical, practical feature of the present invention is that irrespective of the design or configuration of the container, the low-cost adapter is configured, in each instance, to mate interlockingly with the unvaried, identical hinged lid assembly of the invention.

It is a unique feature of the present invention that the closures effect important practical improvements while maintaining a high standard of aesthetic design.

A utilitarian feature of the invention is that the integrally-hinged, flip-top lid is used, without modification, in conjunction with varied adapters configured to cover ovals, rounds, oblongs, rectangular and various other different distinguishable container shapes, contours and design configurations.

A related feature of the invention is that a single configuration of the flip-top, hinged lid assembly finds utility in a broad and varied series of containers as a device or mechanism operational selectively to seal and to open a port communicating with the interior of any of a broad family of material-storing and dispensing vessels or containers.

In preferred embodiments of the invention, the adapter snaps onto the top of the container in an upper annular zone thereof.

In preferred embodiments of the invention the adapters are formed, in a top or surmounting wall thereof, with a downwardly directed, upwardly-opening slot for entry into and for seating therewithin a mounting flange of the flip-top, hinged lid assembly, the flange itself constituting an integral component of the lid assembly.

A related feature of the invention is that the container-surmounting cap or adapter is formed with a discharge port in a top plate thereof, and that the separate flip-top lid is formed on its underside with a pintel-like plug for sealing the port in the cap.

An important practical feature of the invention is that it effects substantial cost savings, obviating the need to fabricate an indefinite number of exceedingly expensive and complicated molds which would be required if a one-piece version of the closure assembly were to be made.

The present invention is useful particularly when the diameter of the skirt of the cap is significantly larger than the physical dimension of the lid as measured from the front to the back of the hinge. A one-piece mold to produce such a structure would be very, very costly.

It is an important cost-saving feature of the invention that it renders possible the use of a single, common lid assembly which can be readily secured to any of a series of relatively inexpensive snap-on caps or adapters surmounting any of a broad variety of bottles or containers.

An advantage of the present invention is that it allows one to develop a container product line into a large family of different sizes, shapes and contours while always using only one flip-top lid, and using only a single mold for the lid assembly.

In a preferred embodiment of the invention, the cap or adapter is formed with a recessed zonal area for accommodating a cover component of the overlying lid so that the final, closed assembly presents a flat, "clean", and aesthetically-pleasing cosmetic appearance.

A feature of the present invention is that a snap-on adapter includes a plate or plate-like panel overlying an open neck of the container, the panel being formed with a through port in communicative registry with an open neck of the container, and through which product stored in the container may be dispensed.

Other and further objects, features and advantages of the invention will become evident upon a reading of the following detailed specifications considered in conjunction with the drawings.

DETAILED DESCRIPTION OF ILLUSTRATED EMBODIMENTS

Figure 1:
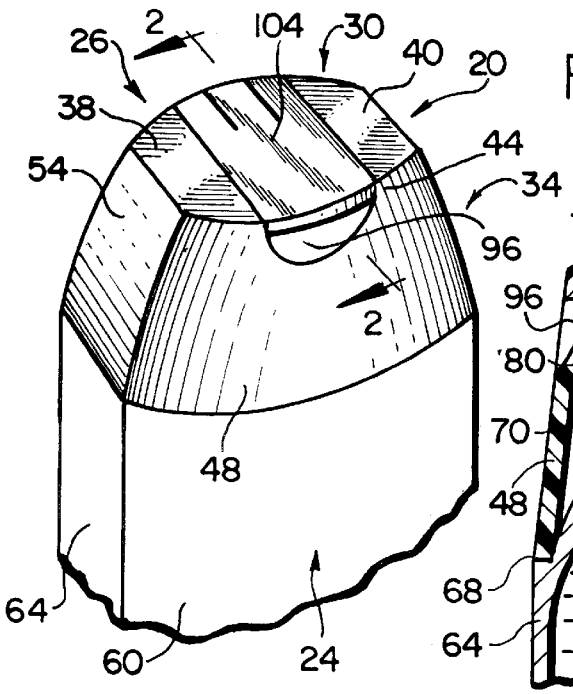
FIG. 1 is a fragmentary, perspective view of a container and a hinged lid assembly attached and closed, according to the present invention.

The aims and objects of the present invention are achieved, in accordance with the practice of the present invention, by providing, as a container closure, a two-piece assembly including a hinged lid of fixed and unvaried configuration and a container cap or adapter interposed between and coupling the container to the hinged lid.

The cap or adapter component is attachable to the container to overlie and sealingly to engage the container neck. The cap or adapter, designed specifically for use with and to accommodate and surmount a particular container, is formed with a through port communicating with the interior of the container through the open neck of the container. The lid or lid assembly component of the container closure includes a cover panel to which there is hingedly joined a mounting flange insertable downwardly into an upwardly opening slot formed in a bounding wall of the supporting cap or adapter. A cover panel of the lid assembly carries on its underside a pintel-like plug which serves as a closure for the orifice in the container-mounted cap or adapter.

A critical feature of the invention is that the same, single lid and hinge assembly is usable with each of an extended and diverse series of different caps, the latter being adapted and configured, in turn, for use with containers having markedly different contours and physical configurations. The present invention obviates the need for complex and costly molds for forming combination one-piece cap and lid structures, a different such intricate mold being required for each different container.

In accordance with the practice of the present invention, the same hinged lid assembly is used on all of the containers, each container having its own relatively simple low cost cap which serves as an "adapter" or functional linking element between each of a broad family of containers or bottles and the same, unvaried hinged lid assembly of the invention.

Referring now to the drawings, and particularly to FIGS. 1 through 5, there is shown, for illustrative purposes only, and not in any limiting sense, a preferred embodiment of the container-surmounting, two-piece closure (an adapter and a fixed, same hinged lid assembly) of the invention incorporating the features thereof.

In the specific first example of the invention depicted, a two-piece closure assembly 20 is mounted on a container 24. The closure assembly includes, as a first component, a cap or adapter 26 having a plate-like top 30 and a circumscribing and depending peripheral wall 34. In the illustrative embodiment pictured in FIGS. 1 through 7, the cap-like top or adapter is generally ellipsoid in shape with truncated end sectors 38 and 40, and a depressed planar center section 44.

The circumscribing principal wall 34 of the adapter cap 26 includes front and rear walls 48 and 50, and interpositioned opposed connecting side walls 54 and 56, all extending upwardly and inwardly from corresponding front and rear walls 60 and side walls 64 and 66 of the container 24 itself. As shown in FIG. 1, and as true in each particular embodiment of the invention, the walls of the caps or adapters 26 etc., are dimensioned and contoured to appear as upwardly directed extensions or continuations of corresponding walls of each of the particular containers 24 etc., themselves.

Figure 2:
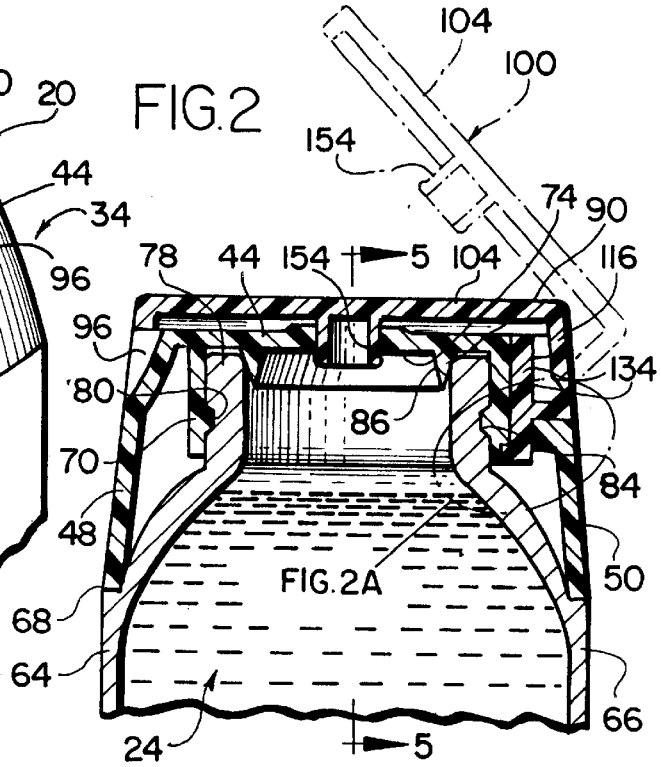
FIG. 2 is a somewhat enlarged cross-sectional view taken substantially on the lines 2—2 of FIG. 1.
Figure 3:
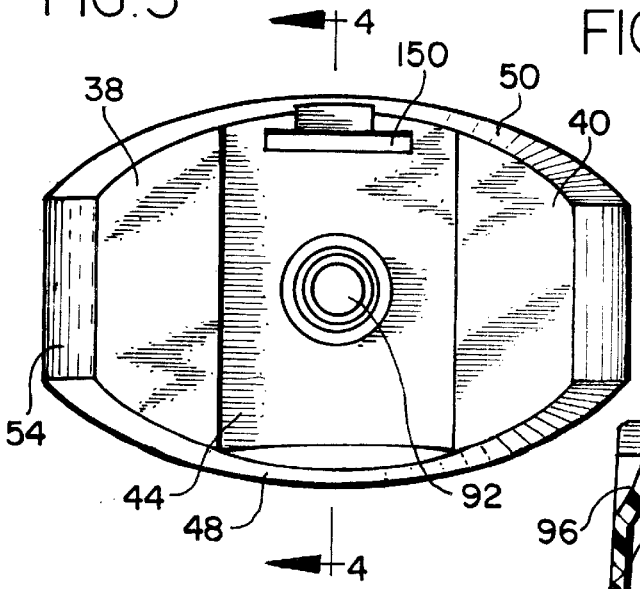
FIG. 3 is a top view showing the cap-like adapter of the invention in place, but without the surmounting separate hinged lid assembly of the invention.
Figure 5:
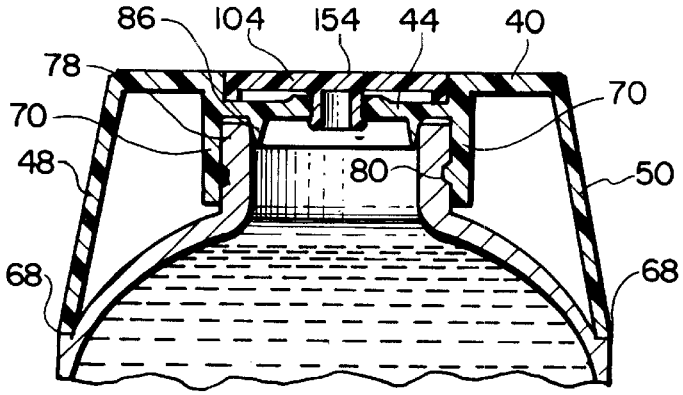
FIG. 5 is a vertical cross-sectional view taken substantially on the lines 5—5 of FIG. 2.
Figure 10:
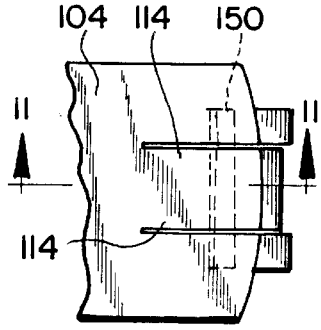
FIG. 10 is a fragmentary top view of the lid and hinge assembly of the invention as it appears when it is installed in place on the adapter or cap of the invention.
Figure 6:
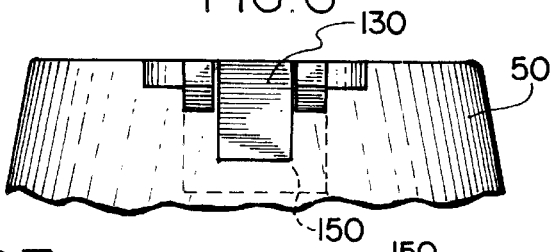
FIG. 6 is a fragmentary view showing the back of the hinged closure assembly, with the hinged lid assembly attached and closed.
Figure 7:
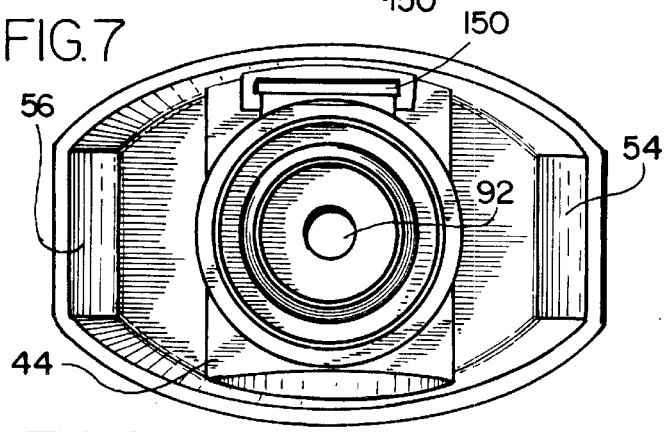
FIG. 7 is a bottom view of the exemplary adapter of the invention shown in FIG. 3.

The specific or particular configuration or design of each container and of the associated adapter is not critical. Such do not constitute, per se, inventive elements of the present invention. Conveniently, the cap or adapter 26 (and the others) is shaped and dimensioned to seat and bear upon an annular, ledge-like shoulder 68 of each particular different container 24, as indicated in FIGS. 1, 2 and 5. A critical feature of the present invention is that, irrespective of the container configuration or design, the same, unvaried, single hinged lid assembly is used. That hinged lid assembly is produced in a single molding operation, from a single mold. The plastics composition used is of the class suited to the production of integrally-formed living or live hinges, as is well known in the art.

Referring further to FIGS. 2 through 5, the adapter 26 is integrally formed with an integral skirt 70 which depends from an undersurface 74 of the adapter top 30. As shown in FIG. 2, when the adapter is positioned in place, the skirt 70 overrides, in sleeving engagement therewith, the neck 78 of the container 24. An annular, inwardly-directed bead 80 integrally formed on the skirt 70 snaps into and lockingly engages within a cooperating annular groove, channel or slot 84 formed in and circumscribing the neck 78 of the container 24. At the same time, a resilient, annular ring-like flange 86, also integrally formed with and depending from the undersurface 74 of the cap 26, is slidably and stressingly received within an open neck 78 of the container 24 to bear against in stressing and in fluid-sealing engagement with a circumscribing upper interior annular edge 90 of the container neck, as shown in FIG. 2.

The plate-like top wall 30 of the adapter 26 is formed with a through bore 92 (FIG. 3) communicating with the interior of the capped container 24, for the dispensing of container-stored material therefrom. The front wall 48 of the adapter 26 is formed with an inwardly-spaced finger-access zone 96 to facilitate the digitally lifting of the hinged sector or top panel, or lid 104 of the hinged lid assembly 100 to open the dispenser, as described more fully herebelow.

Figure 8:
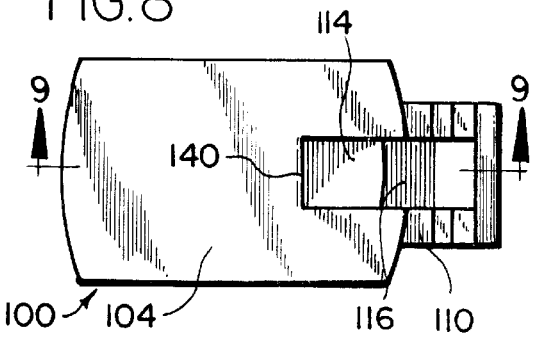
FIG. 8 is a top view of the multi-use hinged lid assembly component of the invention shown in FIG. 3.

The closure assembly 20 includes, in addition to the adapter cap 26, the physically separate and distinct hinged lid assembly 100 which surmounts the adapter cap 26 and is secured thereto. It is an important feature of the invention that the lid assembly 100 is molded as a unitary structure (FIGS. 8, 9, 10 and 11) . FIG. 2 shows the lid cover 104 in an open position, and, schematically, in a closed configuration or disposition. As indicated in FIG. 8, the cover panel 104 of the hinged lid assembly 100 is generally planar, and is dimensioned and shaped to overlie and to be received within perimetric bounds of the depressed center section 44 of top 30 of the container-surmounting adapter 26. (See FIGS. 1, 5 and 6).

Figure 9:
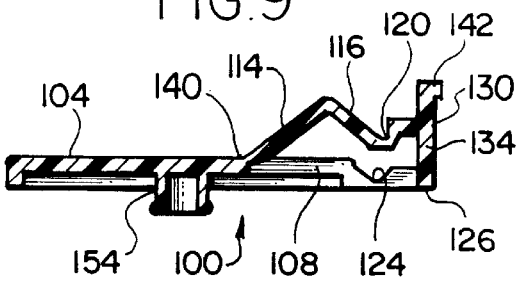
FIG. 9 is a cross-sectional view taken substantially on the lines 9—9 of FIG. 8, and showing the hinged lid assembly as it comes from the mold.

The hinged lid assembly 100 is integrally formed at a rearward end to the principal panel or cover 104 thereof with a hinge structure 106. As shown in FIGS. 8 and 9, the cover 104 includes a T-shaped section including a pair of fixed side panels 108 and 110 coplanar with the cover 104. Disposed therebetween are upwardly-angled center panel-defining leg sectors 114 and 116. The ends of the side panels 108 amd 110 and the leg sector 116 are connected through integrally-formed, mechanically-thinned zones 120 and 124 (FIG. 9) to upper and lower locations 126 and 130 on a plate 134 joined to and extending normally of the cover 104. The thinned zones 120 and 124 define "living" or "live" hinges of plastics composition.

Figure 11:
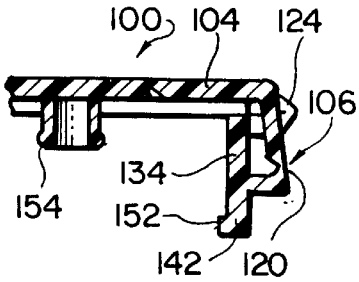
FIG. 11 is a fragmentary, vertical, cross-sectional view taken substantially on the lines 11—11 of FIG. 10, and showing the hinge and lid assembly of the invention in a closed mode.

Rotation of the plate 134 clockwise 180 degrees about the thinned hinge zones 120 and 124, from the orientation shown in FIG. 9 to the position shown in FIG. 11, causes the plate 134 to assume a downwardly-extending mode while, at the same time, the leg sector 114 is bent downwardly at its base to assume an attitude coplanar with the side panels 108 and 110.

The "snap-action" hinge described above is, in various modifications, known in the art. A novel feature of the present invention is that a given, same hinged lid assembly, is used, without modification, for a myriad of different containers.

In the embodiment of the invention illustrated and described, the hinged lid assembly 100 is attached to the adapter 26 by inserting a lowermost end 142 of the plate or flange 134 of the hinge and lid assembly 100 into an upwardly open slot 150 formed in the adapter or cap 26, adjacent a rear wall 50 thereof. On its underside the lid 100 is formed with a downwardly-projecting, pintel-like plug 154 for entry into the dispensing port 92 formed in the plate 44 of the adapter 26 to seal the port 92.

Figure 2A:
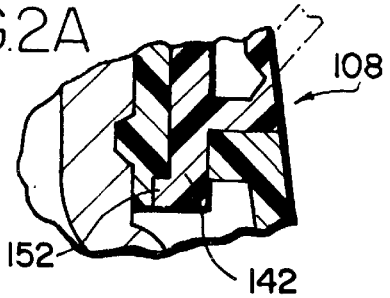
FIG. 2A is an enlarged view of the encircled portion of FIG. 2 showing a detail of the structure securing the hinge assembly of the invention in the container-carried adapter, in accordance with the present invention.
Figure 4:
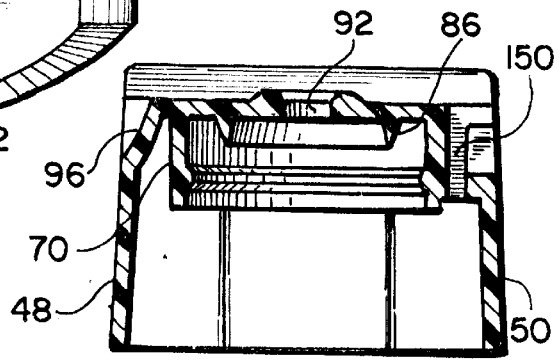
FIG. 4 is a vertical, cross-sectional view taken substantially on the lines 4—4 of FIG. 3.

The lower end 142 of the flange 134 of the hinge assembly 100 of the invention is L-shaped to define an integrally-formed, inwardly-directed lug 152. The lug 152 seats immediately below the lower limit of the skirt 70 of the cap or adapter 26 to lock therebelow, thereby to retain the lid 100 secured in place. This structure is evident in FIG. 2, and is seen more clearly in the enlarged-zone, fragmentary view constituting FIG. 2A.

Figure 12:
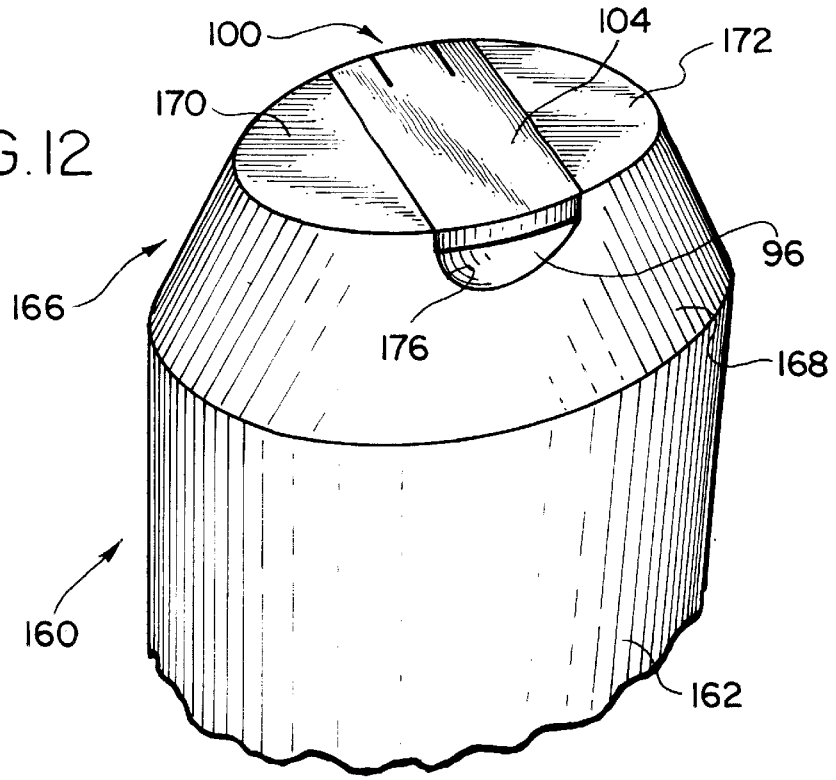
FIG. 12 depicts one form of an alternative container configuration in conjunction with which an adapter in accordance with the present invention, and in which the lid and hinge assembly of the present invention may be employed, without modification.
Figure 13:
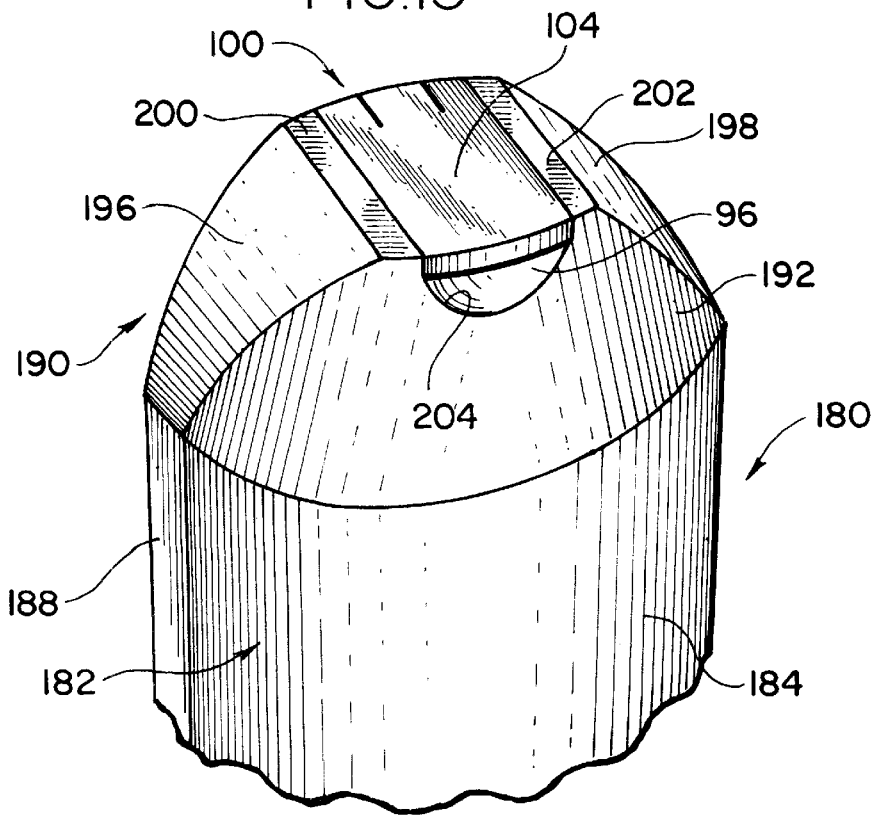
FIG. 13 illustrates yet another container having a configuration different from that dealt with in detail herein, but which also can use the lid and hinge assembly of the present invention.

Referring now to FIGS. 12 and 13, there are shown views of upper body portions of different containers, each with its own, different adapter, but each with the same integrally-formed hinge and lid assembly of the present invention. In FIG. 12 the container 160 depicted has a body 162 which is generally ellipsoidal in transverse cross section. The body 160 is surmounted by an adapter 166 having an upwardly and inwardly directed circumscribing wall 168. The wall 168 is capped with an integral top wall defining a pair of spaced sectors 170 and 172, the latter defining therebetween a recess 176 for receiving and retaining the lid assembly 100 of the invention, in the manner previously described.

In FIG. 13 the container 180 comprises a body 182 having a pair of principal curved front and rearwall sectors 188. The adapter 190 which surmounts and bears upon the container body 182 has upwardly and inwardly directed front and rear sectors 192 and interposed side sectors 196 and 198. The top of the adapter 190 includes opposed fragmentary plates 200 and 202 which define therebetween a depressed zone 204 for accommodating the hinged lid assembly 100 of the invention.

Figure 14:
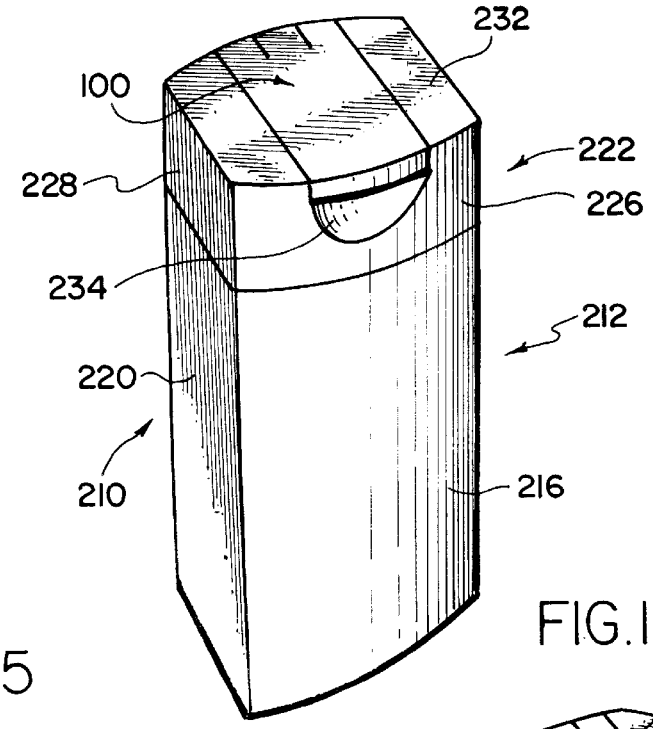
FIGS. 14, 15 and 16 illustrate containers with other configurations, each container having its own adapter, yet each adapter being configured to accommodate and retain the same hinged lid assembly, in accordance with the teachings of the present invention.
Figure 15:
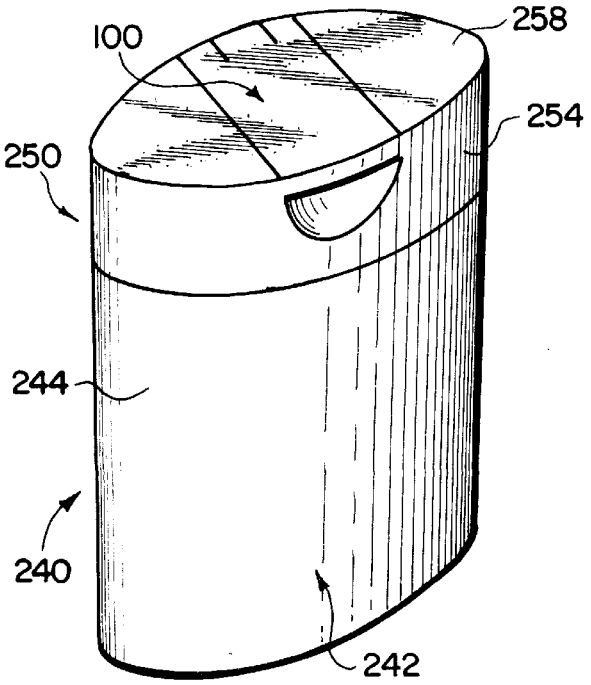
Figure 16:
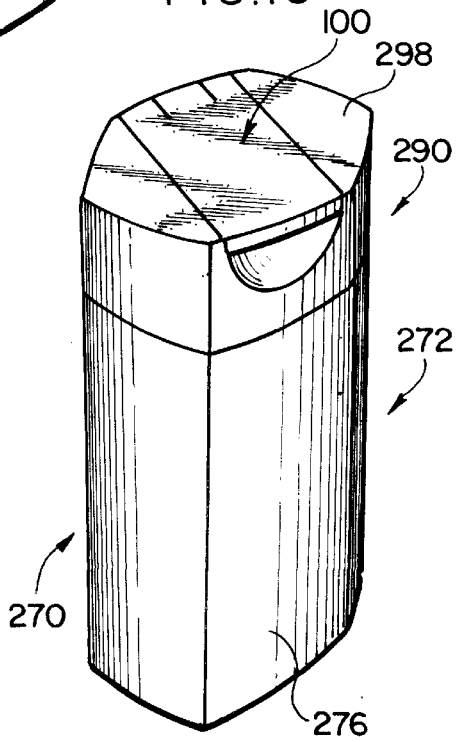

Other, different containers exemplary of the broad utility of the present invention are shown in FIGS. 14, 15 and 16. In FIG. 14 the container 210 has a modified, generally rectangular body 212 with upwardly and inwardly curved front and rear walls 216 and flat sidewalls 220. The container 210 is surmounted by an adapter 222 whose front and rear walls 226 and sidewalls 228 are essentially continuations of the container walls 216 and 220. The adapter 222 has a top 232 formed with a recess 234 centered between the sides 228 and extending from front to rear. The same hinged lid assembly 100 of the invention is contained within the recess 234, in the manner previously described.

FIG. 15 depicts a container 240 having a body 242 whose bounding wall 244 is ellipsoidal in shape. The wall 244 carries a mating adapter 250 whose circumscribing wall 254 is an extension of the container wall 244. The adapter has a top wall 258 configured to receive and to secure the unitary hinge and lid assembly 100 of the invention, in the manner previously described.

The container 270 of FIG. 16 has a body 272 which is hexagonal, with outwardly curved walls 276. An adapter 290, whose walls 294 are extensions of the container walls 276, the adapter surmounting and being carried by the container 270. Fitted in the top wall 298 of the adapter 290 is the integrally formed lid and hinge assembly 100 of the invention, all as previously described.

What is claimed is:

1. The method of employing, selectively, an adapter of a series of different adapters, with the same molded hinged lid assembly functioning as a closure for each of a group of selectable different containers, each of the containers having an integrally-formed, open-top neck, each container being characterized in that it has a different body shape and physical configuration, said method comprising the steps of:

providing a different adapter for each of the different containers, each adapter having the same upper zonal sector, but each adapter having a different base sector, configuring each adapter at the base sector thereof so as physically to conform to one of the shapes and configurations of the different containers, for surmounting and coupling functionally with the open-top neck of one of the different containers, thereby lockingly establishing a fluid-tight seal therewith, configuring each adapter to define an identical top wall surmounting the upper zonal sector of each adapter, and forming the top wall of each adapter with a through opening communicating with the open-top neck of each container and establishing a passageway for discharging therethrough material stored in and to be dispensed from the container, further configuring each adapter at its upper zonal sector thereof for lockingly receiving therewithin and for pivotally supporting thereon the same molded hinged lid assembly for selectively sealing and opening the opening in the top wall of each said adapter, providing the lid assembly with a lid and hinge assembly for surmounting and coupling with each said adapter of the different adapters at each upper zonal sector thereof in fluid-tight interlocking engagement therewith, the method being characterized in that the same, hinged lid assembly is used, without modification, with each container of the series of differently configured containers through each said adapter of the series of different adapters, each said adapter being interposed between to couple each corresponding specific container with the same hinged lid assembly.

2. A separate, selectable, different adapter of a series of different adapters for use in combination with a given respective selectable corresponding different container of a series of different containers, the combination comprising:

a container selectable from a series of containers, each of the series of containers having a different body configuration, each said container having an integrally formed neck open at an upper extremity thereof for introduction of product into and for discharging therefrom of product stored in said container, an adapter selectable from a series of different adapters, each said adapter being integrally formed with a cap including a cover plate, and each said cover plate being formed with a discharge port, each said cover plate being formed with a depending skirt having a means for lockingly engaging said neck of each said different container of said series of containers, a plurality of hinged lid assemblies, each of said hinged lid assemblies having the same shape and configuration, each said cover plate of each said adapter being formed with a downwardly projecting slot for securement of said hinged lid assembly therewithin, each said hinged lid assembly to overlie and to couple with each said adapter of the series of different adapters, each said adapter of the series of different adapters being operable to surmount each said container of the series of selectable corresponding different containers, each said lid assembly including a lid having a top wall and a plug on an underside of said wall, for entry into each said discharge port in each said adapter to control discharge therethrough of material stored in each said container, locking means carried by each said lid assembly for selectively securing each said lid assembly on each said different adapter of each corresponding said different container, a living hinge integrally formed with each said lid at a lower sector thereof for facilitating pivotal opening and closing of each said lid assembly, each said locking means of each said lid assembly including a flange integrally formed with said top wall of said lid for insertion downwardly into said slot in said cover plate of each said adapter, each said flange being formed at a lower extremity thereof with an internal, inwardly-directed lug for engaging and for locking beneath said depending skirt of each said adapter adjacent a base of said slot formed in said cover plate.

* * * * *

UNITED STATES PATENT AND TRADEMARK OFFICE

CERTIFICATE OF CORRECTION

PATENT NO. : 6,039,197

DATED : Mar. 21, 2000

INVENTOR(S) : Morris Braun

It is certified that error appears in the above-identified patent and that said Letters Patent is hereby corrected as shown below:

The Assignee designated on the patent is incorrect.
Please correct to read as follows:

Assignee: W. Braun Company, Chicago, Ill.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*